United States Patent [19]

Kosten

[11] 4,243,095

[45] Jan. 6, 1981

[54] COOLING TOWER

[75] Inventor: Geerard J. Kosten, Dordrecht, Netherlands

[73] Assignee: The Lummus Company, Bloomfield, N.J.

[21] Appl. No.: 12,328

[22] Filed: Feb. 15, 1979

Related U.S. Application Data

[63] Continuation of Ser. No. 788,610, Apr. 18, 1977, abandoned.

[51] Int. Cl.[3] ..... F28B 9/04

[52] U.S. Cl. ..... 165/125; 165/101; 165/103; 165/129; 165/DIG. 1

[58] Field of Search ..... 165/111, 125, 129, DIG. 1; 261/109, DIG. 11

[56] References Cited

U.S. PATENT DOCUMENTS

| | | | |
|---|---|---|---|
| 3,165,455 | 1/1965 | Rose et al. | 165/DIG. 1 |
| 3,400,917 | 9/1968 | Richards | 165/DIG. 1 |
| 3,519,068 | 7/1970 | Harris et al. | 165/122 |
| 3,776,306 | 12/1973 | Michel | 165/DIG. 1 |
| 3,844,344 | 10/1974 | Kliemann et al. | 165/125 |
| 3,888,305 | 6/1975 | Gerz | 165/DIG. 1 |
| 3,942,588 | 3/1976 | Schoonman | 165/125 |
| 3,944,636 | 3/1976 | Schuldenberg et al. | 165/129 |
| 4,040,824 | 8/1977 | Kinney, Jr. | 261/DIG. 11 |

*Primary Examiner*—Sheldon Richter

*Attorney, Agent, or Firm*—Louis E. Marn; Elliot M. Olstein; James N. Blauvelt

[57] ABSTRACT

A cooling tower in which the heat exchangers are arranged to form radially spaced concentric vertical cylinder walls, with air shields being positioned between the concentric cylinder walls to direct air flow through the exchangers. The air shields are upwardly inclined toward the tower center to approximate natural air flow.

16 Claims, 8 Drawing Figures

FIG. 1
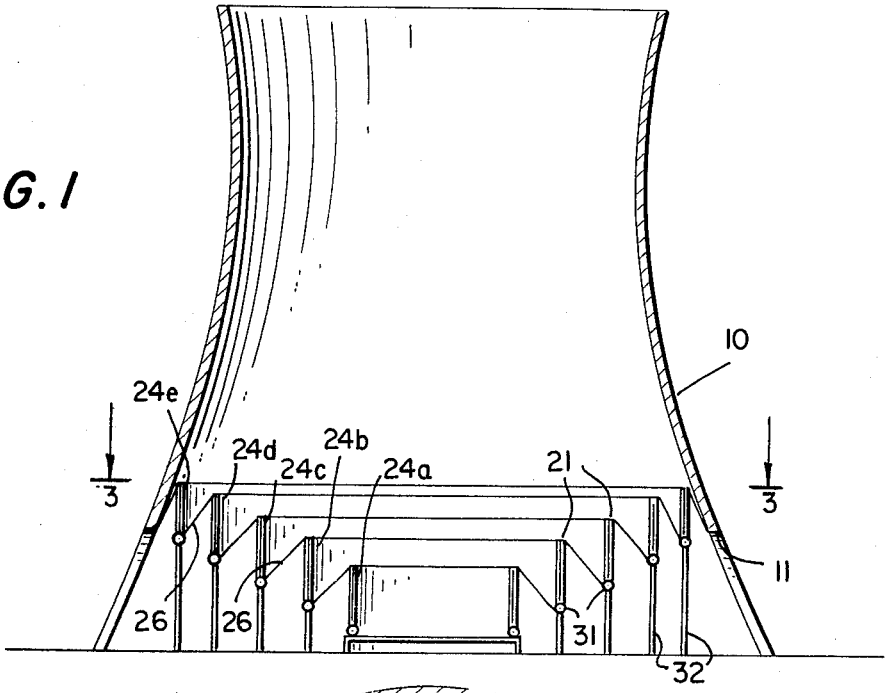
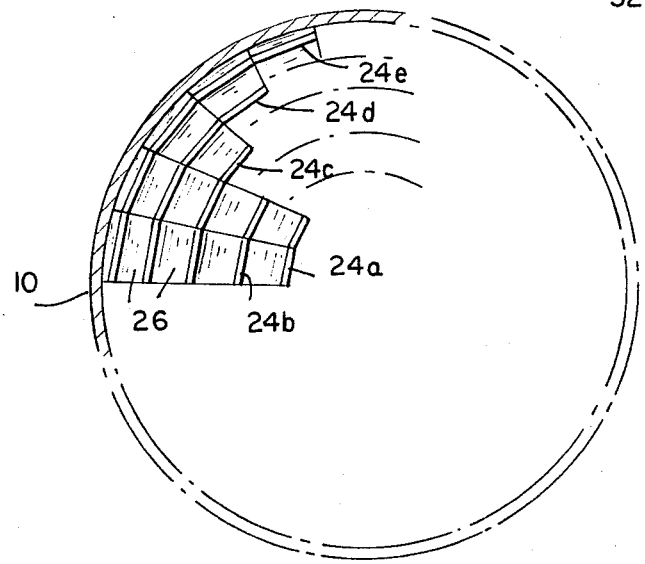
FIG. 3
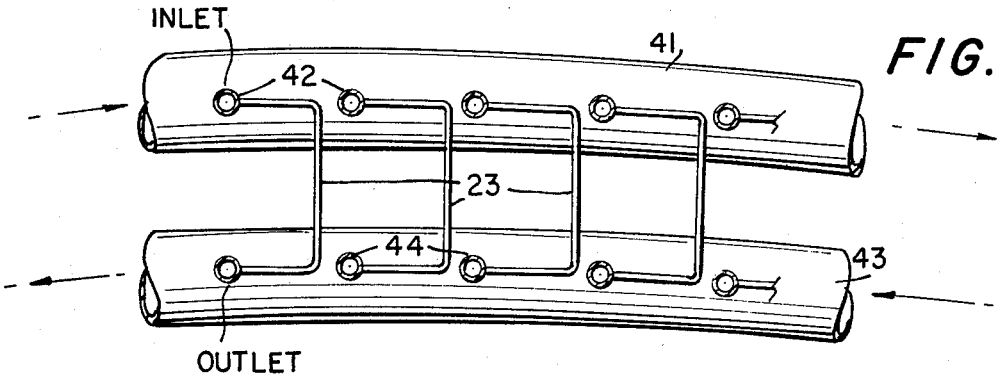
FIG. 4

HYPERBOLIC BUNDLE

PARABOLIC BUNDLE

SINGLE LEVEL BUNDLE

COOLING TOWER

This is a continuation of application Ser. No. 788,610, filed 4/18/77, now abandoned.

This invention relates to cooling towers, and more particularly to cooling towers in which tubular heat exchangers are arranged whereby fluid flowing through the tubes is indirectly cooled by air flow through the tower.

In accordance with the present invention, there is provided a hollow cooling tower having a plurality of heat exchangers within the tower. Each heat exchanger includes a tubular heat transfer surface with the heat exchangers being inwardly spaced from the tower wall and circumferentially positioned to form at least one heat exchanger ring, with the heat transfer surfaces thereof forming ring walls. The heat exchangers are preferably arranged to provide at least two radially spaced rings. The heat exchangers of each ring are preferably arranged whereby the heat transfer surfaces thereof form concentric cylindrical heat transfer walls.

The spacing between the rings and/or the height of the exchangers are coordinated to provide the required ratio of heat transfer surface to air flow area and sufficient area for airflow to the heat transfer surface.

The heat exchangers are provided with suitable air directing means for directing air which is introduced into the tower through the heat exchangers. The air directing means is generally in the form of a plurality of air shields which extend between adjacent rings of heat exchangers with the shields being upwardly inclined from the tower periphery to the tower center. The air shields extend from the bottom of the exchanger of one ring to the top of the exchanger of the next inner ring. The exchangers and shields are arranged so that the air shield inclination corresponds to the tangent to the average direction of air flow through the tower to thereby reduce parisitic losses.

The invention will be further described with respect to the accompanying drawings, wherein:

FIG. 1 is a schematic sectional view of an embodiment of the present invention:

FIG. 3 is a top sectional view taken along line 3—3 of FIG. 1;

FIG. 4 is a partial section along line 4–4 of FIG. 2;

Figure 2:
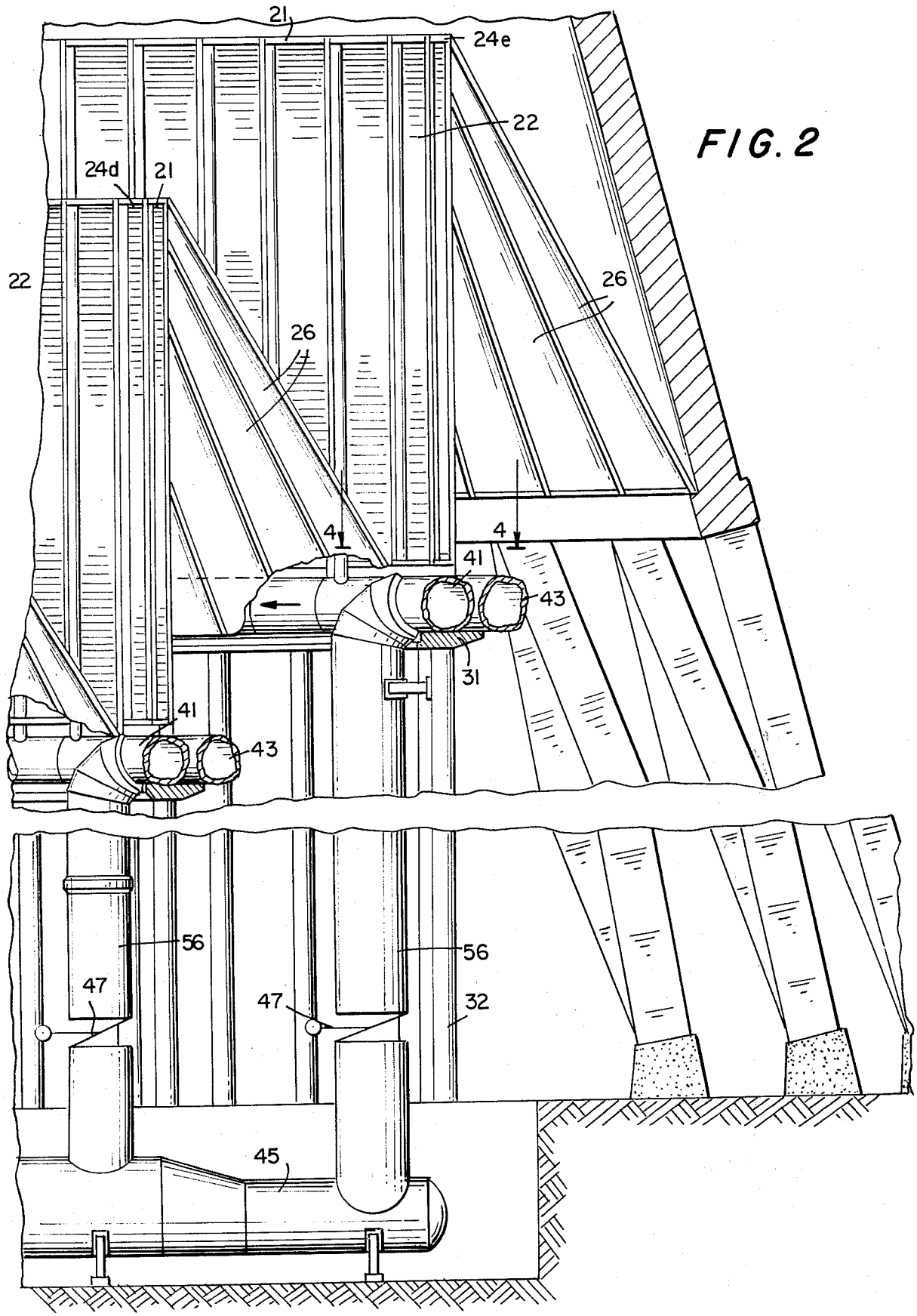
FIG. 2 is a partial section in elevation of the embodiment of FIG. 1.
Figure 5A:
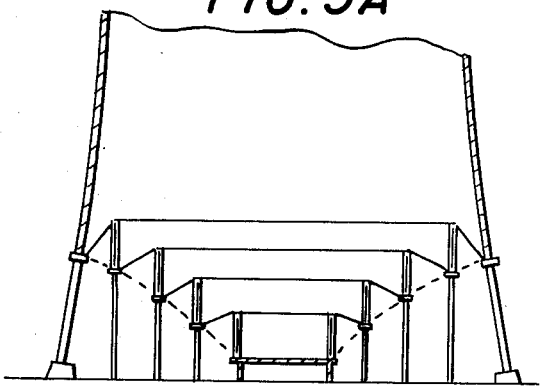
Figure 5B:
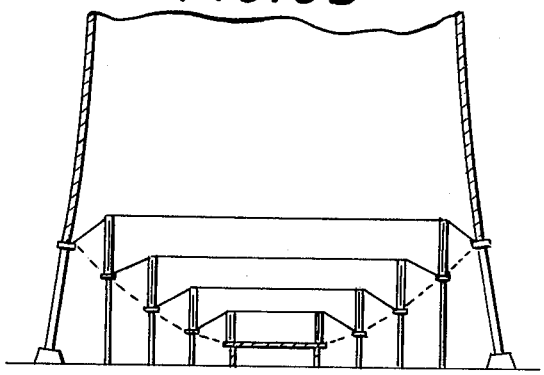
Figure 5C:
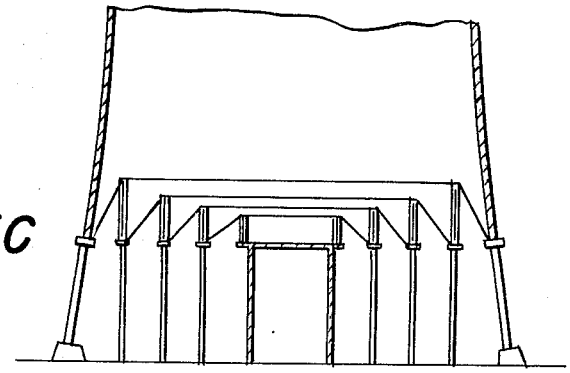
Figure 6:
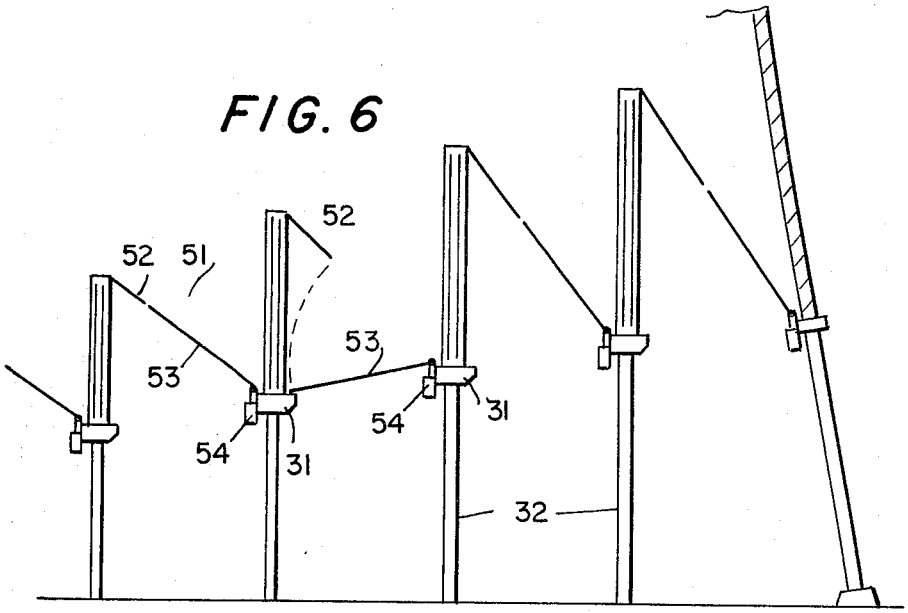

FIGS. 5*a*, 5*b* and 5*c* are schematic representations of various ring configurations; and FIG. 6 is a schematic representation of an embodiment including a modified air directing shield.

Referring to the drawings, there is shown a hollow cooling tower in the form of a natural draft hyperbolic cooling tower 10, having inlets 11 through which cooling air flows, by natural draft, from the surrounding atmosphere. It is to be understood that the tower could be of the forced air type or could be a natural draft tower with a shape other than hyperbolic, i.e., cylindrical or flared.

The lower interior of the cooling tower 10 is provided with a plurality of heat exchangers 21; each of which has a heat exchanger surface 22 in the form of a tube bundle having a plurality of tubes 23. The tubes 23 may be horizontal or vertical tubes, and as particularly shown, the tubes are horizontal. As known in the art, the tubes 23 of each exchanger are suitably arranged to permit air flow through the exchanger whereby fluid flowing through the tubes is cooled by such air flow.

The heat exchangers 21 are circumferentially arranged to form radially spaced rings 24*a*, 24*b*, 24*c*, 24*d* and 24*e*, with the heat transfer surfaces 22 thereof forming substantially vertical ring walls.

As particularly shown, the heat exchanger surfaces or bundles 22 are arranged along tangent planes of concentric vertical cylinders wherein the heat exchanger surfaces define concentric generally vertical cylindrical heat transfer walls.

Air directing means in the form of a plurality of flat shields 26 provided for each ring of heat exchangers to prevent air from flowing upwardly through the spaces between the heat exchanger rings and then direct air through the heat exchangers of each ring. The air shields for each ring are tapered in width from bottom to top and are arranged around the ring coextensive with the heat exchanger surfaces of the ring. The shields interconnect adjacent heat exchanger rings and are downwardly inclined from the top of the heat exchangers of a ring, to the bottom of the heat exchanger of the next outer ring. Each heat exchanger of a ring is preferably individually provided with an air shield 26, although it is possible to provide individual air shields which act as air directing means for two or more exchangers of a ring, or to provide a plurality of shields for each exchanger in the ring. The air shields 26 for the outer ring of exchangers extend downwardly from the top of the exchangers of the outer ring 24*e* to the tower wall.

The air shields 26 are positioned at an angle to approximate the direction of air flow which occurs in the cooling tower 10 to reduce parasitic losses. The proper inclination of the shields such that they approximate the tangent to the average direction of air flow which occurs in tower can be obtained by proper arrangement of the elevation of the cylindrical heat transfer walls with respect to each other, the diameters of the heat exchanger rings and/or the height of the heat exchangers. The air shields 26 for the outer ring of heat exchangers eliminates the ineffective zone of the lintel of the tower by guiding the air which is normally detached at the lintel through the outer ring of heat exchangers.

The heat exchangers 21 generally have a rectangular shape and are positioned with the longer dimension as the height, i.e., the height each exchanger 21 is greater than its width. It is to be understood, however, that the arrangement could be otherwise, although such an arrangement is preferred.

The overall geometry for arranging the concentric cylindrical exchanger surfaces can vary. Thus, the respective concentric heat exchanger ring elevations can be arranged to provide a hyperbolic bundle geometry (FIG. 5*a*), a parabolic bundle geometry (FIG. 5*b*) or a single level bundle geometry (FIG. 5*c*). It is to be understood that other geometries are also possible.

Similarly, in accordance with the present invention, it is possible to select an economic tube bundle height and appropriately adjust the number of rings and distances therebetween to provide a required total bundle surface for a given tower diameter.

Similarly, the required ratio of bundle surface to airflow area can be maintained over the entire tower cross-section by increasing the distance between heat exchanger rings toward the tower center while keeping the height of each bundle constant, or by decreasing the bundle height toward the tower center while maintaining a constant distance between rings.

The heat exchangers of each ring 24*a*, 24*b*, 24*c*, etc. are conveniently supported within the tower on ringbeams 31 which are supported on suitable circumferentially spaced columns 32.

The heat exchangers 21 of each ring can be conveniently provided with a fluid to be cooled or condensed through a ring manifold 41 for each heat exchanger ring, which is appropriately connected to a vertical inlet manifold 42 for each heat exchanger 21 of the heat exchanger ring. The cooled fluid can be withdrawn from each heat exchanger of a heat exchanger ring through an outlet ring manifold 43 which is appropriately connected to the outlet manifold 44 of each exchanger.

A fluid inlet pipe 45 is connected to each ring manifold through suitable interconnecting piping 56 which preferably includes suitable valves 47 whereby one or more rings can be taken out of operation, while maintaining a symmetrical air flow pattern through the remaining rings of heat exchangers. Suitable outlet piping (not shown) and interconnecting pipes (not shown) are provided for withdrawing fluid from the outlet manifold rings 43.

Air flow can be controlled through the heat exchanger rings by providing for movable air shield means which can be moved between a position which directs air flow through the exchanger and a position which prevents air from flowing through the exchanger. An example of such an embodiment is schematically illustrated in FIG. 6.

Referring to FIG. 6, the air shield 51 is divided into a stationary upper part 52 and a movable part 53, with the lower part having a length sufficient to cover the distance between two rings of heat exchangers. The lower part 53 is suitably hinged to the supporting ringbeam 31 and can be moved by a suitable hinge actuator 54, which can be a hydraulic, pneumatic or mechanical-electric actuator. In the lower position, the lower portion of air shields 51 effectively blocks air flow to its ring of exchangers 21. In the upper position, the air shields function to direct air to their respective ring of exchangers.

The movable air shield can be employed to take one or more rings of exchangers or one or more exchangers of a ring out of operation by blocking air flow thereto. In addition, the shields can be effectively employed to control air flow under freezing conditions. Thus, air flow can be stopped for the heat exchangers of a ring by lowering the lower portions of the air shields for that ring, whereby the heat exchangers of that ring are in the warmer airside of the tower and the hot fluids in the tube do not dissipate heat and cannot freeze.

Although the invention has been described with respect to a specific embodiment thereof, the scope of the invention is not to be limited therein. Thus, for example, although the heat exchanger ring walls are preferably in the form of a cylinder, such ring walls could have another form. Thus, for example, the ring walls could have a generally conical shape with the width being downwardly inclined from the tower wall to the tower center.

Similarly, although the tubes of the exchangers are shown as U-tubes, straight tubes could be employed. Similarly, the tubes may be vertical rather than horizontal.

The above modifications and others should be apparent to those skilled in the art from the teachings herein.

The fluid cooled or condensed in the exchangers can be a gas, such as steam, which is condensed by passage through the exchanger tubes or a liquid, such as water, which is cooled in the tubes. Steam condensation is preferably effected in horizontal tubes connected between vertical inlet and outlet manifolding, and water cooling in vertical tubes; however the invention is not limited to such preferred operations.

The exchangers are preferably arranged, as hereinabove described in a manner such that there is an increase in heat transfer area surface from the center of the tower to the periphery thereof in that there is an increase in airflow from the tower center to the tower periphery. In accordance with the present invention, such an increase in area can be provided by increasing the height of the exchangers or by changing the distance between exchanger rings. In addition, the present invention provides for stable operation under reduced load and cross-wind conditions and for varying load-conditions.

These and other advantages should be apparent from the teachings herein.

Numerous modifications and variations of the present invention are possible in light of the above teachings and, therefore, within the scope of the claims the invention may be practiced otherwise than as particularly described.

I claim:

1. A cooling tower, comprising:

a hollow tower comprising air inlet means for introducing air at the lower peripheral wall of the tower and means for withdrawing air from the top of the tower;

a plurality of heat exchangers comprising tubular heat exchanger surfaces positioned within said tower and disposed inwardly from the tower wall, said air inlet means being free of heat exchanger surfaces, said heat exchangers being circumferentially arranged to form at least two radially spaced heat exchanger rings with adjacent heat exchanger surfaces thereof defining vertically disposed ring walls, said rings extending to a progressively higher elevation from the inner ring to the outer ring; and, air directing means for directing air introduced into the tower through the heat exchangers.

2. The cooling tower of claim 1 wherein the heat exchangers of an inner ring extend to a height above the bottom of the heat exchangers of the next outer ring.

3. The cooling tower of claim 1 wherein said heat exchanger surfaces form substantially smooth ring walls.

4. The cooling tower of claim 3 wherein the heat exchangers are arranged to form concentric cylindical heat exchanger surface ring walls.

5. The cooling tower of claim 4 wherein the air directing means is comprised of flat air shields for each heat exchanger ring which are downwardly inclined from the tower center and extend between adjacent heat exchanger rings, with the air shields for the outer heat exchanger ring extending to the tower wall.

6. The cooling tower of claim 5 wherein the air shields are inclined at an angle to approximate natural air flow through the tower.

7. The cooling tower of claim 6 wherein said air shields are comprised of a fixed upper part and a movable lower part, said lower part having a length to cover the distance between heat exchanger rings, said movable lower part being movable between an open position which directs air through the heat exchangers and a closed position which blocks air flow to the heat exchangers.

8. The cooling tower of claim 6 wherein the cooling tower is a natural draft tower.

9. The cooling tower of claim 6 wherein there is a plurality of exchanger rings with the spacing between heat exchanger rings increasing towards the center of the tower.

10. The cooling tower of claim 6 wherein there is a plurality of heat exchanger rings with the heat exchanger height of each ring decreasing toward the tower center.

11. The cooling tower of claim 6 wherein the heat exchangers have a greater height than width.

12. The cooling tower of claim 11 wherein the heat exchangers are arranged along tangent planes of concentric vertical cylinders to form substantially cylindrical heat exchanger surface ring walls.

13. The cooling tower of claim 11 wherein there are more than two rings of heat exchangers.

14. The cooling towers of claim 11 wherein each heat exchanger surface is formed from a plurality of tubes.

15. The cooling tower of claim 14 wherein the plurality of tubes are vertical tubes.

16. The cooling tower of claim 14 wherein the plurality of tubes are horizontal tubes.

* * * * *